US011140490B2

(12) United States Patent
Liang et al.

(10) Patent No.: US 11,140,490 B2
(45) Date of Patent: Oct. 5, 2021

(54) SPEAKER

(71) Applicant: AAC Technologies Pte. Ltd., Singapore (SG)

(72) Inventors: Ping Liang, Shenzhen (CN); Bin Zhao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 23 days.

(21) Appl. No.: 16/705,269

(22) Filed: Dec. 6, 2019

(65) Prior Publication Data

US 2020/0213755 A1 Jul. 2, 2020

(30) Foreign Application Priority Data

Dec. 30, 2018 (CN) ..... 201811645239.9

(51) Int. Cl.

| | |
|---|---|
| ***H04R 9/06*** | (2006.01) |
| ***H04R 7/12*** | (2006.01) |
| ***H04R 9/02*** | (2006.01) |
| ***H04R 7/18*** | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 2307/025* (2013.01); *H04R 2400/11* (2013.01)

(58) Field of Classification Search

CPC ... H04R 7/00; H04R 7/02; H04R 7/04; H04R 7/06; H04R 7/12; H04R 7/122; H04R 7/14; H04R 7/16; H04R 7/18; H04R 7/20; H04R 7/26; H04R 9/00; H04R 9/02; H04R 9/04; H04R 9/041; H04R 9/043; H04R 9/045; H04R 2207/021; H04R 2209/00; H04R 2231/00; H04R 2231/001; H04R 2231/003; H04R 2307/00; H04R 2307/201; H04R 2307/207; H04R 2499/00; H04R 2499/10; H04R 2499/11

See application file for complete search history.

(56) References Cited

U.S. PATENT DOCUMENTS

2010/0316249 A1* 12/2010 Kamimura ..... H04R 9/043 381/399
2010/0322458 A1* 12/2010 Takewa ..... H04R 7/02 381/398
2011/0211725 A1* 9/2011 Takewa ..... H04R 7/04 381/413

(Continued)

*Primary Examiner* — Walter F Briney, III
(74) *Attorney, Agent, or Firm* — W&G Law Group

(57) ABSTRACT

The present application discloses a speaker having a vibrating system and a flexible circuit board. The vibrating system has a lower vibrating diaphragm with a first fastening portion, a second fastening portion, and a vibrating portion having a first connecting portion and a second connecting portion and a middle portion. A vertical distance between a tangent line along a vibrating direction at first end of the first connecting portion and another tangent line along the vibrating direction at the second end of the first connecting portion is a first distance; another vertical distance between a tangent line along the vibrating direction at third end and another tangent line along the vibrating direction at the fourth end is a second distance. The first distance is shorter than the second distance. The acoustic quality of speaker can be improved.

5 Claims, 4 Drawing Sheets

(56) References Cited

U.S. PATENT DOCUMENTS

| | | | | |
|---|---|---|---|---|
| 2014/0318885 | A1* | 10/2014 | Kim | H04R 7/14 181/171 |
| 2016/0014522 | A1* | 1/2016 | Matsumura | H04R 7/18 381/398 |
| 2016/0057543 | A1* | 2/2016 | Salvatti | H04R 9/043 381/398 |
| 2016/0173990 | A1* | 6/2016 | Park | H04R 1/06 381/354 |
| 2017/0366900 | A1* | 12/2017 | Linghu | H04R 31/003 |
| 2020/0213756 | A1* | 7/2020 | Liang | H04R 9/06 |
| 2020/0213757 | A1* | 7/2020 | Liang | H04R 7/20 |

* cited by examiner

SPEAKER

FIELD OF THE PRESENT INVENTION

The present invention relates to the field of electro-acoustic transducer technology, and more particularly to a speaker.

DESCRIPTION OF RELATED ART

With the rapid development of technology, the popularization of speaker has come higher and higher. People's demand to speakers not only limited at the video and audio playing function, but also higher quality and reliability of the sound played by the speakers. A diaphragm of speaker is directly related to the sound quality and the stability of the product.

In the related art, a speaker has a lower vibrating diaphragm and a flexible circuit board bonded to the lower vibrating diaphragm. During the vibration of the lower vibrating diaphragm, as an inner side of a vibrating portion of the lower vibrating diaphragm is a curved surface, for some speaker products, the space between the inner side of the vibrating portion of the lower vibrating diaphragm and the flexible circuit board will be insufficient, and therefore the inner side of the vibrating portion of the lower vibrating diaphragm will easily collide with the flexible circuit board during the vibration of the lower vibrating diaphragm, resulting in defective speakers with impure ton and abnormal performance.

DETAILED DESCRIPTION OF THE EXEMPLARY EMBODIMENT

The present invention will be hereinafter further described in detail with reference to drawings and embodiments.

Figure 1:
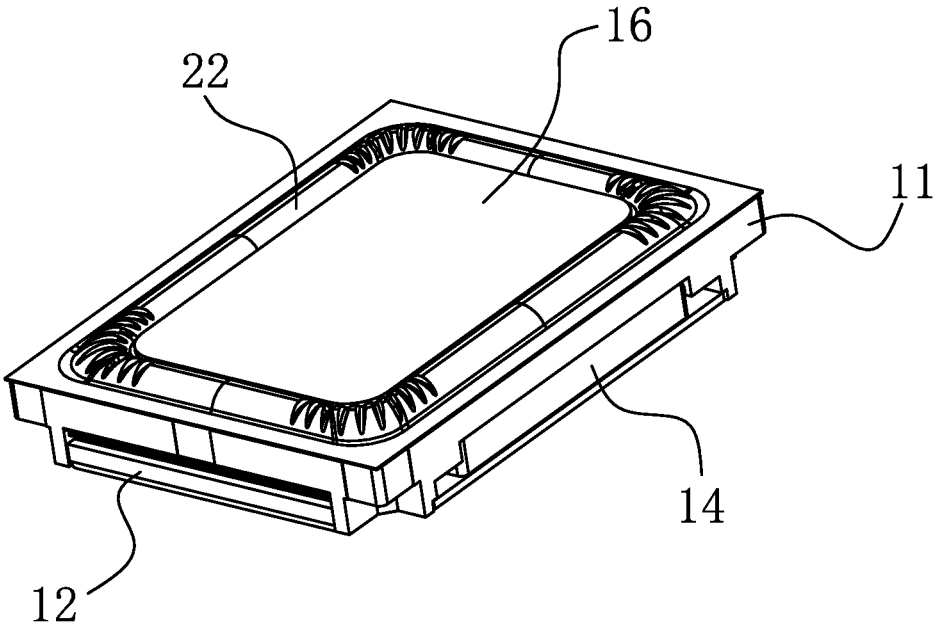
FIG. 1 is an isometric view of a speaker according to an embodiment of the present invention.
Figure 2:
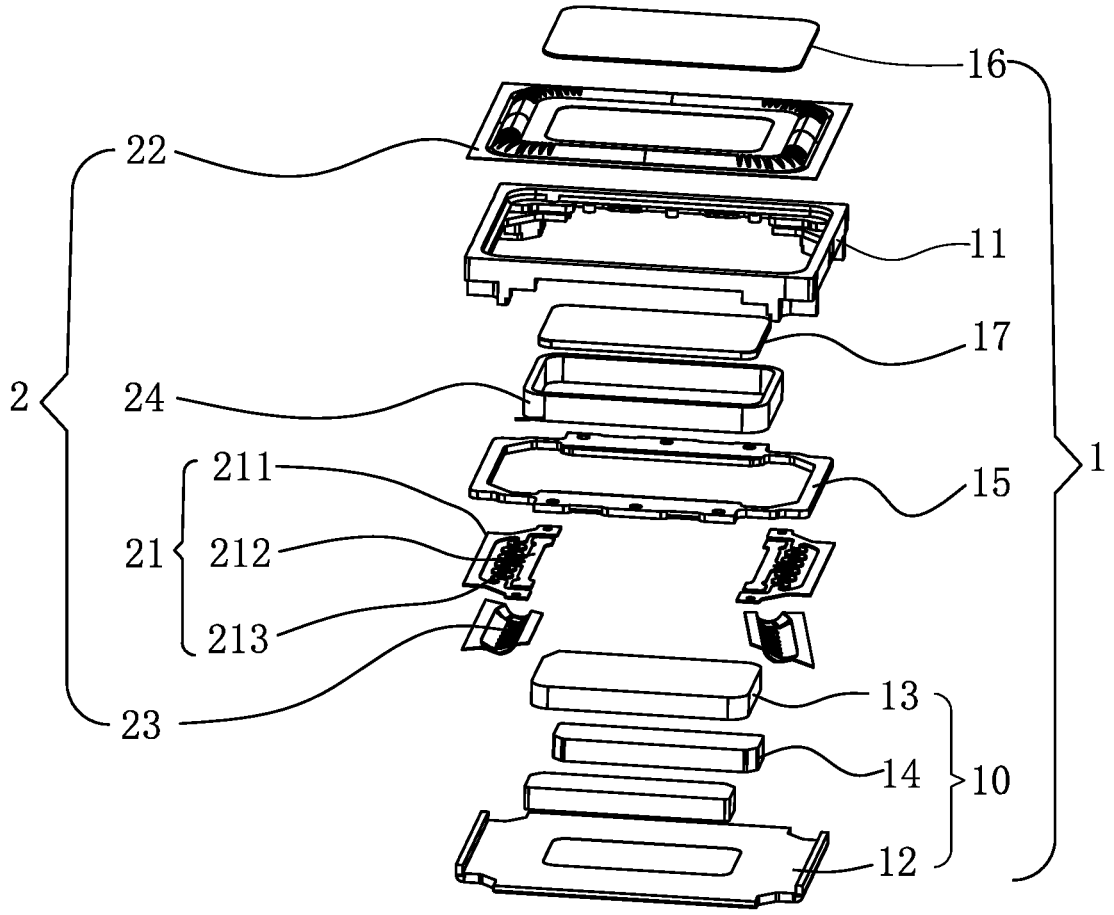
FIG. 2 is an exploded view of the speaker in FIG. 1.
Figure 3:
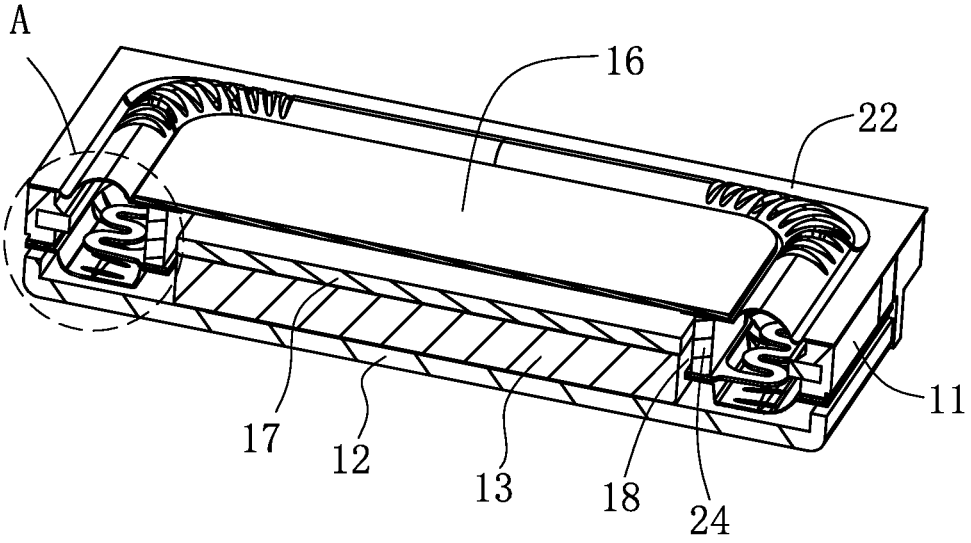
FIG. 3 is a cross-sectional view of the speaker of FIG. 1.
Figure 4:
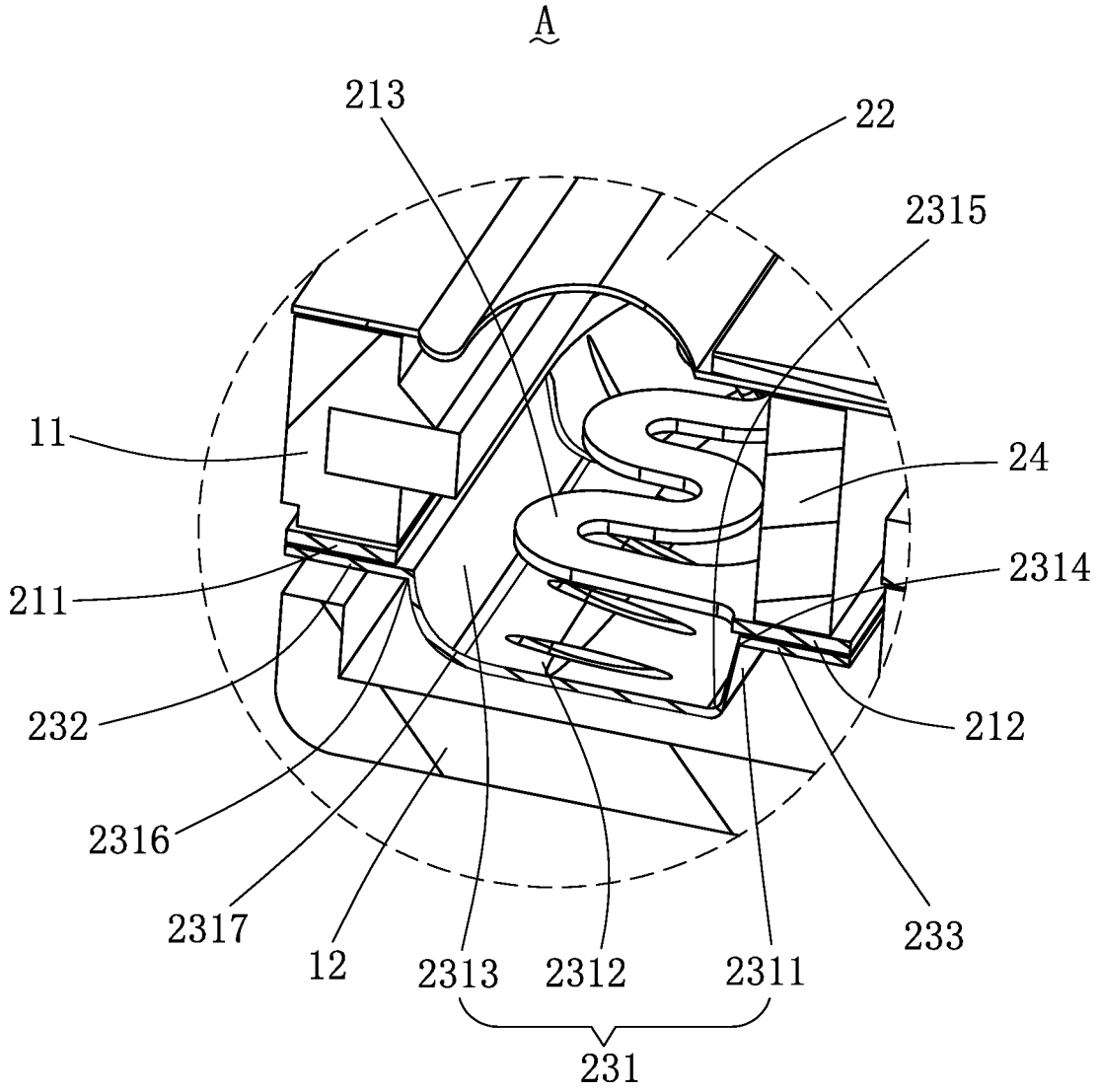
FIG. 4 is an enlarged view of section A in FIG. 3.

Referring to FIGS. 1-4, the present invention discloses a speaker. The speaker comprises a fixing system 1 with a receiving space, a vibrating system 2 approaching and away from the fixing system 1 along a vibrating direction and a flexible circuit board 21 both accommodated in the receiving space. The fixing system 1 includes a frame 11 with the receiving space, a fixing member 15 fixedly connected to the frame 11, and a magnetic circuit system 10 accommodated in the receiving space of the frame 11. The magnetic circuit system 10 includes a magnetic yoke 12 fixed on the frame 11, a main magnet 13 positioned in the middle of the magnetic yoke 12, and auxiliary magnets 14 arranged on both sides of the magnetic yoke 12 and forming a magnetic gap 18 with regard to the main magnet 13. The vibrating system 2 includes an upper vibrating diaphragm 22 fixed on an upper side of the frame 11, a voice coil 24 connected with the upper vibrating diaphragm 22 for driving the upper vibrating diaphragm 22 to vibrate, a flexible circuit board 21 fixed on a lower side of the voice coil 24, and a lower vibrating diaphragm 23 fixed on a lower side of the flexible circuit board 21. The voice coil 24 is inserted in the magnetic gap 18, an inner upper side of the flexible circuit board 21 is fixed on the lower side of the voice coil 24, and an outer upper side of the flexible circuit board 21 is fixed on the frame 11.

The lower vibrating diaphragm 23 includes a first fastening portion 233 connected to the voice coil 24, a second fastening portion 232 fixedly connected to the frame 11, and a vibrating portion 231 connecting the first fastening portion 233 with the second fastening portion 232. The flexible circuit board 21 is sandwiched and configured between the voice coil 24 and the first fastening portion 233. The vibrating portion 231 includes a first connecting portion 2311 connected to the first fastening portion 233, a second connecting portion 2313 connected to the second fastening portion 232, and a middle portion 2312 connecting the first connecting portion 2311 with the second connecting portion 2313. The first connecting portion 2311 includes a first end 2314 connected to the first fastening portion 233 and a second end 2315 connected to the middle portion 2312. The second connecting portion 2313 includes a third end 2316 connected to the second fastening portion 232 and a fourth end 2317 connected to the middle portion 2312. A vertical distance between a tangent line along the vibrating direction at the first end 2314 and another tangent line along the vibrating direction at the second end 2315 is referred as a first distance. Another vertical distance between a tangent line along the vibrating direction at the third end 2316 and another tangent line along the vibrating direction at the fourth end 2317 is referred as a second distance. The first distance is shorter than the second distance. The voice coil 24 drives the upper vibrating diaphragm 22 for producing sound via vibrating, and drives the lower vibrating diaphragm 23 and the flexible circuit board 21 to vibrate together with the upper vibrating diaphragm 22. A vibrating space of the lower vibrating diaphragm 23 is improved through the structure of the lower vibrating diaphragm 23 described above, so that the space between the vibrating portion 231 of the lower vibrating diaphragm 23 and the flexible circuit board 21 becomes larger, and therefore the first connecting portion 2311 can keep a certain distance from the flexible circuit board 21 during the vibration of the lower vibrating diaphragm 23, thereby effectively preventing collision between the vibrating portion 231 of the lower vibrating diaphragm 23 and the flexible circuit board 21, and thus improving the quality of the sound and ensuring the stability of the speaker.

In the embodiment, in order that the lower vibrating diaphragm 23 can obtain a larger vibrating space without meeting the flexible circuit board 21, the first distance is configured as 0. That is, the first connecting portion 2311 and the middle portion 2312 form an angle of 90 degrees. The first connecting portion 2311 is a flat-plate structure, and the second connecting portion 2313 is an arc structure. In other embodiments, the first connecting portion and the second connecting portion may also have other shapes, the angle between the middle portion and the first connecting portion may be an obtuse angle. A specific angle degree may be adjusted based on the structure of the vibrating diaphragm 23 according to practical needs.

In the above embodiment, the flexible circuit board 21 includes a first fixing portion 211, a second fixing portion 212, and an elastic connecting portion 213. An upper side of the first fixing portion 211 is fixedly connected to the frame 11, and a lower side of the first fixing portion 211 is fixedly connected to the second fastening portion 232 of the lower vibrating diaphragm 23. An upper side of the second fixing portion 212 is connected to the voice coil 24, and a lower side of the second fixing portion 212 is fixedly connected to the first fastening portion 233 of the lower vibrating diaphragm 23. The elastic connecting portion 213 is connected between the first fixing portion 211 and the second fixing portion 212, and an orthographic projection along the vibration direction of the elastic connecting portion 213 is spaced apart from the first connecting portion 2311.

In the above embodiment, the fixing system 1 further includes a pole piece 17 which is fixed on the main magnet 13 away from the magnetic yoke 12. The magnetic yoke 12, the fixing member 15 and the pole piece 17 all are made of magnetic conductive material. The upper vibrating diaphragm 22 and the lower vibrating diaphragm 23 are made of polymer material, such as silica gel, rubber, PEEK (polyetheretherketone) or TPU (Thermoplastic polyurethanes), and so on.

In the above embodiment, the voice coil 24 is a racetrack shape, or other annular structure. The voice coil 24 drives the upper vibrating diaphragm 22 which is fixed on the frame 11, and a reinforcing plate 16 is further fixed on the upper vibrating diaphragm 22. The reinforcing plate 16 may be arranged on a side of the upper vibrating diaphragm 22 toward the main magnet 13 as well as a side of the upper vibrating diaphragm 22 away from the main magnet 13. The reinforcing plate 16 can improve the stability of the upper vibrating diaphragm 22.

In summary, the speaker of the present invention improves the shape and structure of the lower vibrating diaphragm so that the vertical distance between the tangent line along the vibrating direction at the first end of the first connecting portion and another tangent line along the vibrating direction at the second end is arranged shorter than a vertical distance between a tangent line along the vibrating direction at the third end and another tangent line along the vibrating direction at the fourth end. In this way, the vibration space of the lower vibrating diaphragm is improved, and the first connecting portion can keep the certain distance from the flexible circuit board during the vibration of the lower vibrating diaphragm, thereby improving the acoustic quality of the speaker, ensuring stability of the speaker, and improving product performance.

The above is only preferred embodiment of the present invention, it should be noted that those skilled in the art can still make improvements without departing from the inventive concept, but these are all belong to the protection scope of the present invention.

What is claimed is:

1. A speaker, comprising a frame with a receiving space, a vibrating system for vibrating along a vibrating direction, a magnetic circuit system and a flexible circuit board accommodated in the receiving space, the vibrating system comprising an upper vibrating diaphragm fixed on the upper side of the frame, a voice coil for driving the upper vibrating diaphragm for producing sound via vibrating, and a lower vibrating diaphragm connected fixedly to the lower side of the frame, wherein, the lower vibrating diaphragm comprises a first fastening portion connected to the voice coil, a second fastening portion fixedly connected to the frame, and a vibrating portion connecting the first fastening portion with the second fastening portion; the flexible circuit board is sandwiched and configured between the voice coil and the first fastening portion;

the vibrating portion includes a first connecting portion connected to the first fastening portion, a second connecting portion connected to the second fastening portion and a middle portion connected the first connecting portion and the second connecting portion;

the first connecting portion includes a first end connected to the first fastening portion and a second end connected to the middle portion; the second connecting portion includes a third end connected to the second fastening portion and a fourth end connected to the middle portion;

a vertical distance between a tangent line along a vibrating direction at the first end and another tangent line along the vibrating direction at the second end is referred as a first distance; another vertical distance between a tangent line along the vibrating direction at the third end and another tangent line along the vibrating direction at the fourth end is referred as a second distance; and the first distance is shorter than the second distance; the first distance is set as 0;

the first connecting portion has a flat-plate shape; the second connecting portion has an arc shape; a vertical distance between the second end and the fourth end along the vibrating direction is set as 0.

2. The speaker according to claim 1, wherein the flexible circuit board includes a first fixing portion, a second fixing portion, and an elastic connecting portion; the first fixing portion is connected to the frame, the second fixing portion is connected to the voice coil, and the elastic connecting portion is connected between the first fixing portion and the second fixing portion; and an orthographic projection of the elastic connecting portion along the vibrating direction is spaced apart from the first connecting portion.

3. The speaker according to claim 2, wherein a material of the upper vibrating diaphragm and the lower vibrating diaphragm are made of polymer material.

4. The speaker according to claim 3, wherein the polymer material are silica gel, rubber, PEEK or TPU.

5. The speaker according to claim 2, wherein a vertical distance between the first end and the second end along the vibrating direction equals a vertical distance between the third end and the fourth end along the vibrating direction.

* * * * *